US011052402B2

(12) United States Patent
Tsai et al.

(10) Patent No.: US 11,052,402 B2
(45) Date of Patent: Jul. 6, 2021

(54) AUTOMATIC PAPER SHREDDER WITH STAPLE REMOVING STRUCTURE AND STAPLE REMOVING METHOD USING SAME

(71) Applicant: Aurora Office Equipment Co., Ltd. Shanghai, Shanghai (CN)

(72) Inventors: Chung Shih Tsai, Hawthorne, CA (US); Er Ren Zhong, Shanghai (CN); Taokuei Chuang, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 0 days.

(21) Appl. No.: 16/289,524

(22) Filed: Feb. 28, 2019

(65) Prior Publication Data

US 2021/0138478 A1 May 13, 2021

(51) Int. Cl.
*B02C 18/00* (2006.01)
*B02C 18/14* (2006.01)
*B02C 18/22* (2006.01)

(52) U.S. Cl.
CPC ..... *B02C 18/0007* (2013.01); *B02C 18/142* (2013.01); *B02C 18/2283* (2013.01); *B02C 2018/003* (2013.01); *B02C 2018/0038* (2013.01)

(58) Field of Classification Search
CPC . B02C 18/0007; B02C 18/003; B02C 18/142; B02C 18/2283; B02C 2018/003
See application file for complete search history.

(56) References Cited

U.S. PATENT DOCUMENTS 8,146,845 B2 * 4/2012 Chen ..... B02C 18/0007 241/100
8,348,185 B2 * 1/2013 Ferril ..... B02C 18/0007 241/30
8,439,286 B2 * 5/2013 Pan ..... B02C 18/0007 241/166
8,651,404 B2 * 2/2014 Chang ..... B02C 18/2225 241/81
8,727,255 B2 * 5/2014 Kim ..... B02C 23/02 241/225
9,016,606 B1 * 4/2015 Aries ..... B02C 23/08 241/81
9,409,182 B2 * 8/2016 Carson ..... B02C 18/2266
9,669,411 B2 * 6/2017 Matlin ..... B65H 1/04
9,776,191 B2 * 10/2017 Schwelling ..... B02C 18/2283
9,802,202 B2 * 10/2017 Aries ..... B02C 23/02
10,646,878 B1 * 5/2020 Chang ..... B02C 23/02
(Continued)

*Primary Examiner* — Faye Francis
(74) *Attorney, Agent, or Firm* — WHGC, P.L.C.; John F. O'Rourke; Alexander R. Schlee

(57) ABSTRACT

An automatic paper shredder with a staple removing structure and a staple removing method using the same. The automatic paper shredder includes a shredder cover, a paper holding box, a shell, a paper holding plate, a paper inlet, a paper shredding component, a drive motor, a paper pick-up component, a paper pressing plate, a straight through-hole, a waste paper bin and a staple removing component. The automatic paper shredder removes a staple (or clip) on a stack of paper through cooperation with a paper shredding structure. Paper can be automatically picked up in batches. Meanwhile, damage caused by staples to the whole shredder is prevented, and thus, the whole shredder is protected in use and has a longer service life.

23 Claims, 7 Drawing Sheets

(56) References Cited

U.S. PATENT DOCUMENTS

| | | | | |
|---|---|---|---|---|
| 2008/0210794 | A1* | 9/2008 | Schwelling | B02C 18/0007 241/225 |
| 2010/0044484 | A1* | 2/2010 | Chen | B02C 18/0007 241/101.5 |
| 2014/0103151 | A1* | 4/2014 | Xu | B02C 18/0007 241/28 |
| 2014/0263774 | A1* | 9/2014 | Matlin | B02C 18/2266 241/28 |
| 2015/0343451 | A1* | 12/2015 | Xu | B02C 23/00 241/34 |
| 2016/0199847 | A1* | 7/2016 | Murayama | B02C 18/0007 162/261 |
| 2016/0236201 | A1* | 8/2016 | Aries | B02C 18/0007 |

* cited by examiner

AUTOMATIC PAPER SHREDDER WITH STAPLE REMOVING STRUCTURE AND STAPLE REMOVING METHOD USING SAME

BACKGROUND

Technical Field

The invention generally relates to paper shredders, and in particular, to an automatic paper shredder with a staple removing structure and a staple removing method using the same.

Description of Related Art

Paper shredders are composed of a set of rotary blades, a paper comb and a drive motor. Paper is fed between the mutually-engaged blades to be cut into numerous paper scraps, thereby ensuring the confidentiality. As security equipment serves as a security function and can keep modern office environments clean, paper shredders have become indispensable simple devices in offices.

In the prior art, automatic and continuous paper shredders are provided with an automatic paper feed mechanism, and such paper shredders can automatically draw in paper placed on a paper holding plate of the paper feed mechanism and then automatically shred paper drawn therein. However, when the paper shredders are used to shred files bound together with staples, one of the following two situations can happen if the staples are not removed:

First, too many pieces of paper are drawn in at a time and cannot be shredded by the paper shredders, and consequentially, the paper shredders are jammed with paper and stop operating. Second, a piece of to-be-drawn-in paper is dragged by the staples and the rest of paper and cannot be drawn into the paper shredders, and consequentially, the paper shredders stop operating. Alternately, the to-be-drawn-in paper is pulled into the paper shredders together with other files binding with the paper, and consequentially, the paper shredders get jammed and stop operating.

Files to be shredded by automatic and continuous paper shredders frequently are bound together with staples, and only after the staples on the files are removed, the files can be shredded by the paper shredders. The staple removing process is troublesome and time-consuming, but if the staples are not removed, the files bound together with the staples cannot be automatically shredded by the paper shredders. What is needed is an automatic paper shredder with a staple removal structure.

BRIEF SUMMARY

Provided are an automatic paper shredder with a staple removing structure, and a staple removing method using the same, are provided which can automatically remove staples or clips or both, thus, greatly improving paper shredding efficiency and saving time. An automatic paper shredder with a staple removing structure also can prevent damage by staples and/or clips to the whole paper shredder, thus, protecting the whole paper shredder in use and prolonging the service life of the paper shredder.

The automatic paper shredder with a staple removing structure includes a shredder cover, a paper holding box, a shell, a paper holding plate, a paper inlet, a paper shredding component, a drive motor, a paper pick-up component, a paper pressing plate, a straight through-hole, a waste paper bin, and a staple removing component. The shredder cover is pivotally connected with one end of the paper holding box and is used for closing or opening the paper shredder. The shell is disposed below the paper holding box and is fixedly connected with the paper holding box. The paper holding plate is disposed on the upper end face of the inner side of the paper holding box and is used for holding a stack of paper placed thereon by users. The paper inlet is formed in the paper holding plate and divides the paper holding plate into a first paper holding plate part and a second paper holding plate part. The paper shredding component comprises a first cutter shaft and a second cutter shaft, wherein the first cutter shaft and the second cutter shaft are respectively disposed below the left side and the right side of the paper inlet and are used in cooperation to shred paper entering the paper inlet. The drive motor is disposed inside the paper holding box, is connected with the first cutter shaft, the second cutter shaft and the paper pick-up component, and is used for driving the first cutter shaft and the second cutter shaft and for causing the paper pick-up component to operate. The paper pressing plate is elastically connected to the lower end face of the shredder cover through a plurality of elastic components, is disposed corresponding to the upper surface of the paper holding plate, and is used for tightly pressing against the stack of paper placed on the paper holding plate when the users close the shredder cover. The paper pick-up component includes a paper pick-up roller shaft and paper pick-up rollers, wherein the paper pick-up roller shaft is disposed inside the first paper holding plate part and is close to the paper inlet. The paper pick-up rollers are telescoped around the paper pick-up roller shaft, wherein the upper parts thereof partially protrude from the upper surface of the first paper holding plate part via paper pick-up holes formed in the first paper holding plate part, and are driven by the drive motor to rotate, so that the bottom piece of paper in the stack of paper placed on the paper holding plate is driven by the paper pick-up rollers to move towards the inner wall of the paper holding box and then to move reversely under a counter-acting force of the inner wall. The bottom piece of paper is bent and deformed at the paper inlet so as to move downwardly to enter the paper inlet. The straight through-hole is formed in one side or two sides of the paper holding plate and is communicated with the waste paper bin. Removed staples (or clips) fall into the waste paper bin located on the lower portion of the paper shredder after passing the straight through-hole. The waste paper bin is disposed inside the shell and is used for collecting paper scraps. The staple removing component is located at an end of the first paper holding plate part or an end away from the paper inlet, or is located at an end of the second paper holding plate part, away from the paper inlet. The staple removing component is used to abut against a staple (or clip) with a vertical surface when the paper pressing plate presses against the stack of paper on the paper holding plate, so that the staple (or clip) deflects and is separated from the bottom piece of paper when the bottom piece of paper in the stack of paper enters the paper inlet. In general, the staple removing component is parallel to the paper inlet. Optionally, the staple removing component is an angled part of the end of the second paper holding plate part away from the paper inlet, of the first paper holding plate part. In addition, the staple removing component is an angled part of the end of the second paper holding plate part away from the paper inlet. Furthermore, the staple removing component optionally may be a staple removing plate, which is fixedly disposed at an angled position of the end of the first paper holding plate part away from the paper inlet, or at an angled position of the end of the second paper holding plate part away from the paper inlet. The staple removing plate is made from metal. The paper holding plate is obliquely disposed by a predetermined angle with respect to the horizontal plane. The first paper holding plate part and the second paper holding plate part sequentially incline downwards to allow the users to conveniently place the stack of paper thereon and to reduce the friction force on the stack of paper. The lower surface of the paper pressing plate may be parallel to the upper surface of the paper holding plate. The first paper holding plate part is longer than the second paper holding plate part in the direction perpendicular to the paper inlet.

The automatic paper shredder further can include a storage slot, in which the storage slot is formed in the outer side of the end of the first paper holding plate part and/or the second paper holding plate part away from the paper inlet and is used to recover staples (or clips) for reuse. The automatic paper shredder further includes a storage plate, wherein the storage plate is transversely disposed in the straight through-hole and forms, together with the circumferential side wall of the straight through-hole, a half-open recovery slot which is open upwards and is used to recover staples (or clips) for reuse. The automatic paper shredder further includes a magnet, in which the magnet is disposed in the storage slot or the recovery slot and is used to attract scattered staples (or clips).

Furthermore, the paper pressing plate is matched in shape with the paper holding plate. Alternately, the paper pressing plate is larger than or as large as the paper holding plate. The inner wall of the paper holding box is not provided with u-shaped or n-shaped holding strips, used for holding the four corners of the stack of paper, at horizontal positions corresponding to the upper surfaces of the first paper holding plate part and the second paper holding plate part. A first lug is disposed in the middle of the end, away from the paper inlet, of the first paper holding plate part, has an upper surface even with the upper surface of the first paper holding plate part, and extends towards the inner wall of the paper holding box. A second lug is disposed in the middle of the end, away from the paper inlet, of the second paper holding plate part. A third lug is disposed at a position, corresponding to the second lug, of the inner wall of the paper holding box. The upper surfaces of the second lug and the third lug are even with the upper surface of the second paper holding plate part. A gap is formed between the second lug and the third lug, and the second lug is matched with the third lug in shape.

Optionally, the gap is formed in the upper surfaces of the second lug and the third lug or the lower surfaces of the second lug and the third lug, or penetrates through the upper surfaces and the lower surfaces of the second lug and the third lug. When the gap is formed in the upper surfaces of the second lug and the third lug, the second lug is connected with the lower end of the third lug, and the straight through-hole in the left sides and right sides of the second lug and the third lug is integrated with the gap. When the gap is formed in the lower surfaces of the second lug and the third lug, the second lug is connected with the upper end of the third lug, and the straight through-hole in the left sides and right sides of the second lug and the third lug is integrated with the gap. When the gap penetrates through the upper surfaces and the lower surfaces of the second lug and the third lug, the straight through-hole in the left sides and right sides of the second lug and the third lug is integrated with the gap.

The invention further discloses a staple removing method using an automatic paper shredder. The staple removing method uses the above-mentioned automatic paper shredder for paper shredding and staple removing. The method includes opening the shredder cover of the paper shredder and placing pieces of stacked paper bound together with a staple (or clip) at any one of four corners onto the paper holding plate obliquely disposed with respect to the horizontal plane. The method also includes closing the shredder cover, and tightly pressing the stacked paper placed on the paper holding plate by the paper pressing plate, which is disposed on the lower end face of the shredder cover and elastically connected with the shredder cover through the plurality of elastic components. The lower surface of the paper pressing plate is parallel to the upper surface of the paper holding plate. The method additionally includes starting the drive motor of the paper shredder to drive the first cutter shaft and the second cutter shaft, which are disposed below the left side and the right side of the paper inlet in the paper holding plate, to operate and simultaneously to rotatingly drive the paper pick-up rollers disposed around the paper pick-up roller shaft, which is located inside the first paper holding plate part and is close to the paper inlet. The method further includes picking up the bottom piece of stacked paper placed on the paper holding plate by the paper pick-up rollers, so that the bottom piece of paper is made to move towards the inner wall of the paper holding box and then to move reversely under a counter-acting force of the inner wall. The bottom piece of paper is bent and deformed at the paper inlet so as to downwardly enter the paper inlet. The method still further includes abutting against the staple (or clip) by the vertical surface of the staple removing component located at the end, away from the paper inlet, of the first paper holding plate part or the second paper holding plate part while the paper pressing plate tightly presses against the stacked paper on the paper holding plate, so that the staple (or clip) deflects to be separated from the bottom piece of paper when the bottom piece of paper in the stacked paper enters the paper inlet. The staple removing component is parallel to the paper inlet.

The staple removing method includes enabling the removed staple (or clip) to pass through the straight through-hole which is formed in one side or two sides of the paper holding plate and communicated with the waste paper bin and then to fall into the waste paper bin located on the lower portion of the paper shredder after. Recovering the staple (or clip) for reutilization, (1) by the storage slot which is formed in the outer side of the end, away from the paper inlet, of the first paper holding plate part or the second paper holding plate part, or both, or (2) by the half-open recovery slot which is open upwards and is formed by the storage plate transversely disposed in the straight through-hole and the circumferential side wall of the straight through-hole. Scattered staples (or clips) are attracted by the magnet disposed in the storage slot or the recovery slot.

BRIEF DESCRIPTION OF THE DRAWINGS

The foregoing and other aspects of the invention may be more fully understood from the following description, when read together with the accompanying drawings in which like reference numbers indicate like parts. Embodiments of the invention will now be described, by way of example, with reference to the accompanying drawings, in which.

Figure 1A:
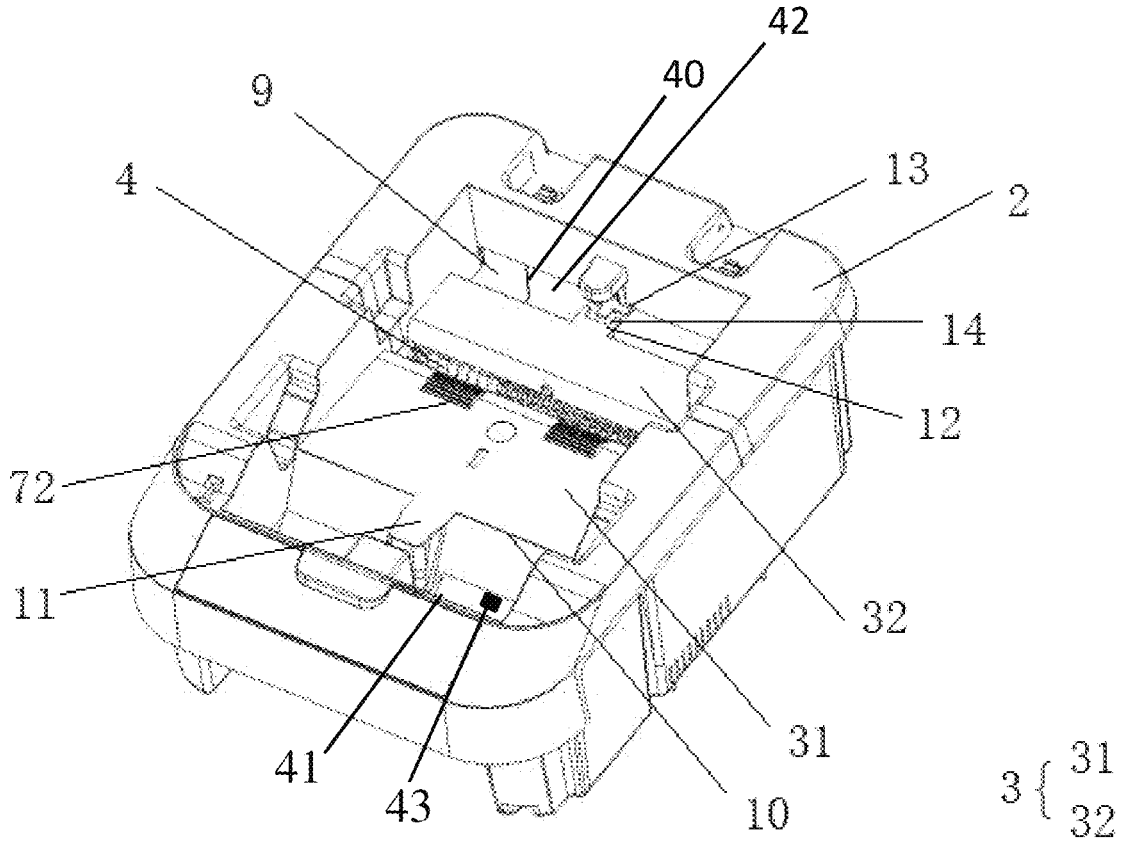
FIG. 1A is a partial structural view of a paper holding box of the automatic paper shredder with a staple removing structure, in accordance with teachings of the present invention.

Some embodiments are described in detail with reference to the related drawings. Additional embodiments, features and/or advantages will become apparent from the ensuing description or may be learned by practicing the invention. In the FIGURES, which are not drawn to scale, like numerals refer to like features throughout the description. The following description is not to be taken in a limiting sense but is made merely for describing the general principles of the invention.

DETAILED DESCRIPTION OF THE EMBODIMENTS

In embodiments of the invention, the paper holding plate of the automatic paper shredder with the staple removing structure is obliquely disposed to better conform to the using habits of users, and thus, the users can place a stack of paper on the paper holding plate conveniently. Meanwhile, the friction force on the stack of paper can be reduced by being decomposed into a component force in the horizontal direction and a component force in the vertical direction. The design of one-side configuration of the paper pick-up component of the automatic paper shredder with the staple removing structure simplifies the paper pick-up structure and reduces the economic cost. The lower surface of the paper pressing plate of the automatic paper shredder with the staple removing structure is parallel to the upper surface of the paper holding plate so that all corners of the stack of paper placed on the paper holding plate can be tightly pressed and compacted. The automatic paper shredder with the staple removing structure is provided with the storage slot, the storage plate and the magnet so that staples (or clips) can be recovered to be reused. Through the paper pick-up rollers on one side and the asymmetrical configuration of the paper holding plate of the automatic paper shredder with the staple removing structure, paper is moved forwards after being picked up and is bent above cutter cores of the paper shredding component, and after the bent point of the paper is grabbed by the set of cutter cores, the paper is pulled to rotate until the paper is completely shredded.

When multiple pieces of paper bound together with a staple (or clip) are shredded, the bottom piece of paper in contact with the paper pick-up rollers is grabbed by the cutter cores, the staple and the paper above are reversely pulled, the rest of paper with the tail end bound together with the staple is bent to the maximum degree. When the bottom piece of paper is completely shredded, the staple is left on the piece of paper above, this process is performed repeatedly until all the pieces of paper on the paper pick-up rollers are shredded, and thus, automatic paper shredding and staple removing are realized. The automatic paper shredder with the staple removing structure overcomes the defects of the prior art and can automatically remove staples (or clips) on a stack of paper through cooperation with a paper shredding structure, without operation of workers by hand or other tools. Paper can be automatically picked up in batches, and thus, the overall paper shredding efficiency is improved. Damage by staples (or clips) to the whole shredder is prevented, and thus, the whole shredder is protected in use and has a longer service life. In general, the automatic paper shredder has the characteristics of being high in automation degree, convenient to use, safe, reliable, ingenious in design, simple in structure, low in cost, and efficient.

Embodiment 1

Figure 1B:
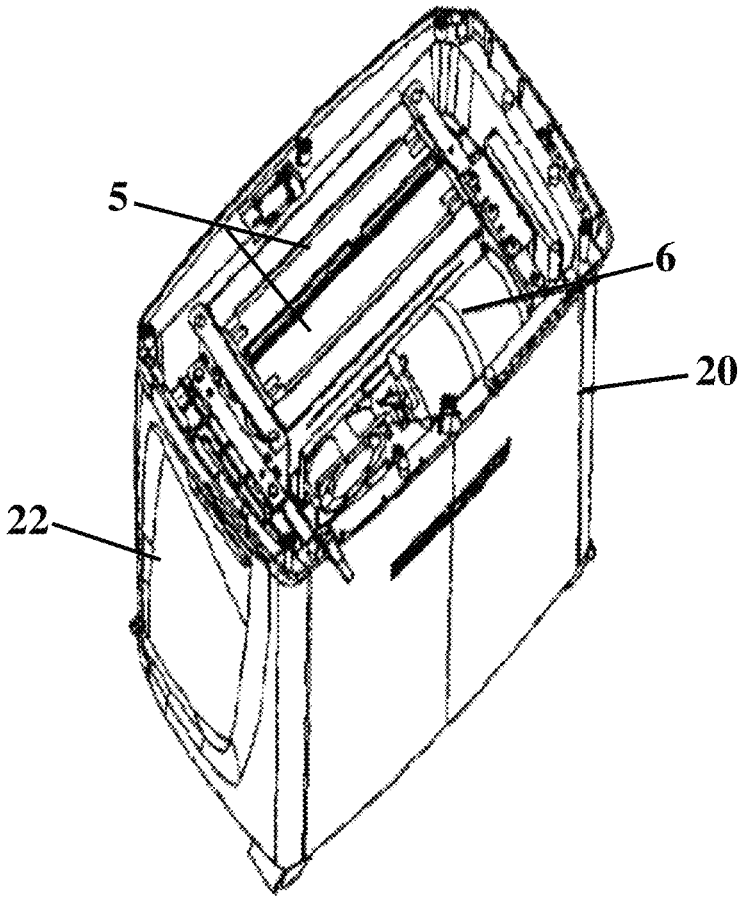
FIG. 1B is a partial structural view of a cross-section of the automatic paper shredder with a staple removing structure of FIG. 1A, in accordance with teachings of the present invention.
Figure 2A:
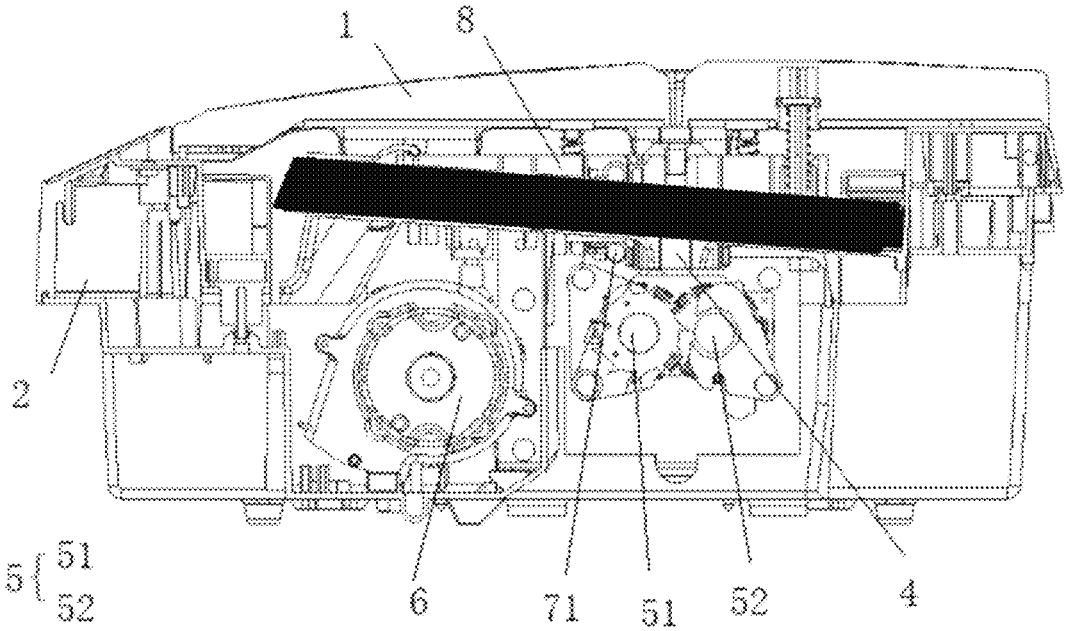
FIG. 2A is a first state diagram of the automatic paper shredder with the staple removing structure in the automatic paper shredding process, in accordance with teachings of the present invention.
Figure 2B:
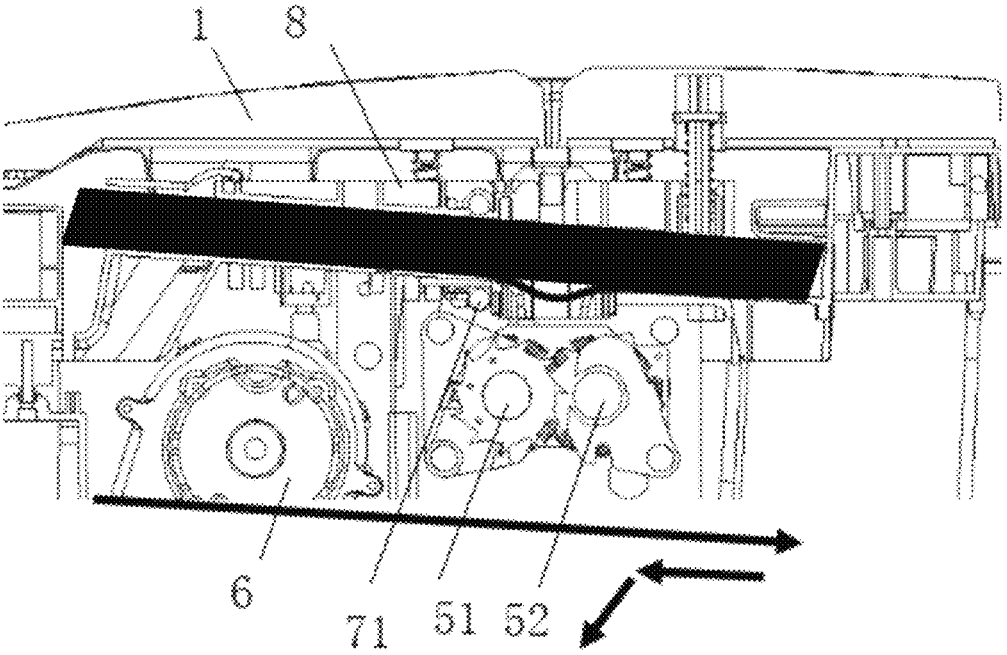
FIG. 2B is a second state diagram of the automatic paper shredder with the staple removing structure in the automatic paper shredding process, in accordance with teachings of the present invention.
Figure 2C:
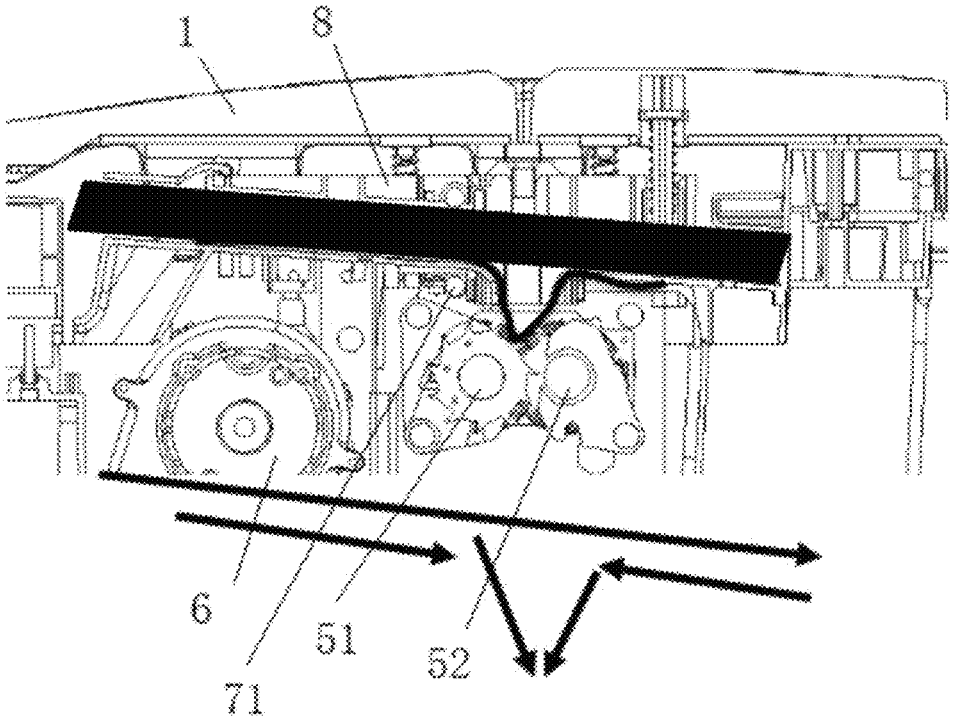
FIG. 2C is a third state diagram of the automatic paper shredder with the staple removing structure in the automatic paper shredding process, in accordance with teachings of the present invention.
Figure 2D:
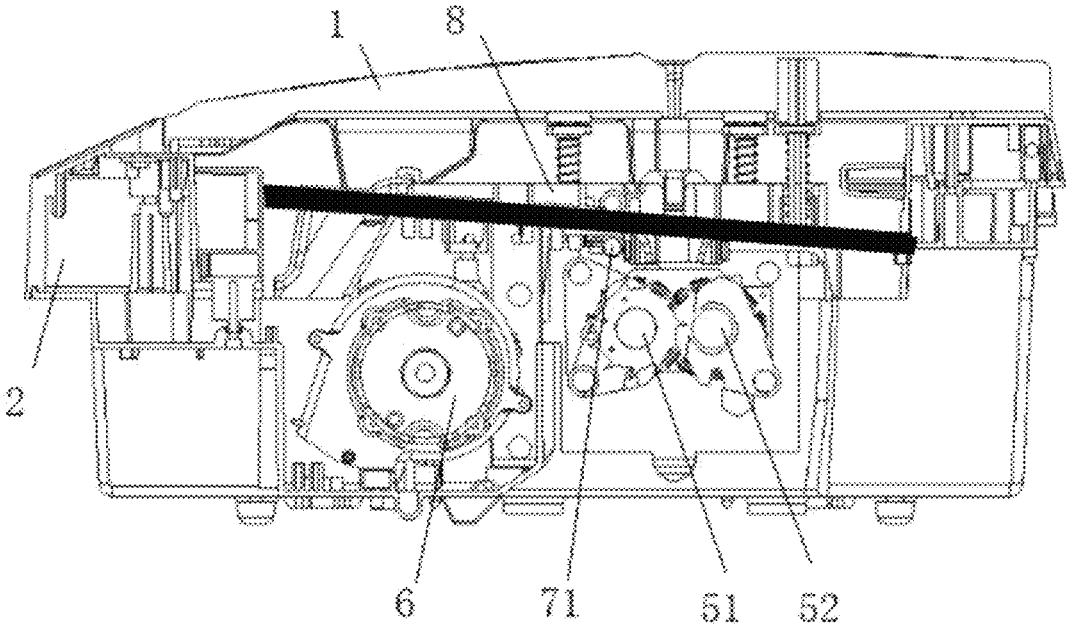
FIG. 2D is a fourth state diagram of the automatic paper shredder with the staple removing structure in the automatic paper shredding process, in accordance with teachings of the present invention.

As shown in FIGS. 1A and 1B, an automatic paper shredder 100 with a staple removing structure is provided. The automatic paper shredder with the staple removing structure includes shredder cover 1, paper holding box 2, shell 20, paper holding plate 3, paper inlet 4, paper shredding component 5, drive motor 6, paper pick-up component 7, paper pressing plate 8, straight through-hole 9, a waste paper bin 22 and staple removing component 10. Shredder cover 1 is pivotally connected with one end of paper holding box 2 and is used for closing or opening the paper shredder. Shell 20 is disposed below paper holding box 2 and is fixedly connected with paper holding box 2. In this embodiment, a connection type such as clamped connection, a riveted connection or a threaded connection can be adopted to realize a fixed connection between shell 20 and paper holding box 2. Paper holding plate 3 is disposed on the upper end face of the inner side of paper holding box 2 and is used for holding a stack of paper placed thereon by users. As used herein, a "stack" also may apply to one piece of paper. Paper inlet 4 is formed in paper holding plate 3, and divides paper holding plate 3 into first paper holding plate part 31 and second paper holding plate part 32. Paper shredding component 5 comprises first cutter shaft 51 and second cutter shaft 52. First cutter shaft 51 and second cutter shaft 52 are respectively disposed below the left side and the right side of paper inlet 4 and are used in cooperation to shred paper entering paper inlet 4. Drive motor 6 is disposed inside paper holding box 2, is connected with first cutter shaft 51, second cutter shaft 52 and paper pick-up component 7. Drive motor 6 is used for driving first cutter shaft 51 and second cutter shaft 52 and for causing paper pick-up component 7 to operate. Paper pressing plate 8 is elastically connected to the lower end face of shredder cover 1 through a plurality of elastic components and is disposed corresponding to the upper surface of paper holding plate 3. Paper pressing plate 8 is used for tightly pressing against the stack of one or more pieces of paper placed on the paper holding plate 3 when a user closes shredder cover 1.

FIGS. 2A-2D provide graphical illustrations of an automatic paper shredding process. Paper pick-up component 7 includes paper pick-up roller shaft 71 and paper pick-up rollers 72. Paper pick-up roller shaft 71 is disposed inside first paper holding plate part 31 and is close to the paper inlet 4. Paper pick-up rollers 72 are disposed around paper pick-up roller shaft 71 and have upper parts partially stretching out of the upper surface of the first paper holding plate part 31 via paper pick-up holes formed in the first paper holding plate part 31. Paper pick-up rollers 72 are driven to rotate by the drive motor 6, so that the bottom piece of paper in the stack of paper placed on paper holding plate 3 is driven by paper pick-up rollers 72 to move towards the inner wall of paper holding box 2 and then to move reversely under a counter-acting force of the inner wall. The bottom piece of paper is bent and deformed at paper inlet 4 to downwardly enter paper inlet 4. In this embodiment, the number of paper pick-up rollers 72 is two. However, there is no limitation in this regard, and the number of paper pick-up rollers 72 also can be three or more. In addition, one-side configuration of the paper pick-up component simplifies the paper pick-up structure and reduces the economic cost. This embodiment is different from the prior art scheme, in which paper pick-up rollers 72 are respectively disposed on two sides of a paper inlet. In the prior art, the bottom piece of paper in a stack of paper is moved towards the center (above the paper inlet) from two sides by the paper-pick up rollers located on the two sides of the paper inlet. However, in this embodiment, the bottom piece of paper in the stack of paper is moved, by paper pick-up rollers 72 located on one side, towards the inner wall of paper holding box 2, then is reversely moved under the counter-acting force of the inner wall. The bottom piece of paper then is bent and deformed at the paper inlet 4 so as to downwardly enter the paper inlet 4. Both ends of the paper are drawn towards cutter cores of the set of cutter shafts of the paper shredder. Straight through-hole 9 is in one side or two sides of paper holding plate 3 and communicates with waste paper bin 22. Removed staples (or clips) pass through straight through-hole 9 to fall into waste paper bin 22 located on the lower portion of the paper shredder. Waste paper bin 22 is disposed inside shell 20 and is used for collecting paper scraps. Staple removing component 10 is located at an end away from paper inlet 4, of the first paper holding plate part 31 or an end, away from the paper inlet 4, of the second paper holding plate part 32. Staple removing component 10 is used to abut against a staple (or clip) with a vertical surface when paper pressing plate 8 is tightly pressed against the stack of paper on the paper holding plate 3, so that the staple (or clip) deflects to be separated from the bottom piece of paper in the stack of paper when the bottom piece of paper enters paper inlet 4. In FIG. 1A, staple removing component 10 is parallel to paper inlet 4. In this embodiment, staple removing component 10 is an angled part of the end, away from paper inlet 4, of the first paper holding plate part 31. Alternately, staple removing component 10 is an angled part of the end, away from the paper inlet 4, of the second paper holding plate part 32.

In selected embodiments, staple removing component 10 is a staple removing plate, which is fixedly disposed (1) at an angled position of the end, away from paper inlet 4, of first paper holding plate part 31, or (2) at an angled position of the end, away from paper inlet 4, of the second paper holding plate part 32. In such embodiments, the staple removing plate can be fixed in a buckled connection manner, a clamped connection manner, or a glued connection manner. Compared with the scheme of using the angled part of first paper holding plate part 31, or the angled part of second paper holding plate part 32, as the staple removing component 10, the staple removing plate is not prone to being worn and has a longer service life. Preferably, the staple removing plate is made from a metal. In these embodiments, the staple removing plate can be an iron sheet or other rigid objects if the front end of the first paper holding plate part 31 is made rigid enough to resist against staples (or clips) without being worn. In order to resist against the staples (or clips), the iron sheet can be designed in different shapes. As a simple term, "staple removing plate" represents any plates capable of separating staples, clips or other paper fasteners from one or more pieces of paper, as mentioned herein. Furthermore, paper holding plate 3 is obliquely disposed by a predetermined angle with respect to the horizontal plane. First paper holding plate part 31 and second paper holding plate part 32 sequentially incline downwards so that the users can conveniently place the stack of paper on first paper holding plate part 31 and second paper holding plate part 32. The friction force on the stack of paper is reduced by being decomposed into a component force in the horizontal direction and a component force in the vertical direction. In this embodiment, the lower surface of paper pressing plate 8 is parallel to the upper surface of paper holding plate 3 so that all corners of the stack of paper placed on the paper holding plate 3 can be tightly pressed and compacted by the paper pressing plate 8. As can be seen from FIG. 1A, first paper holding plate part 31 is longer than second paper holding plate part 32 in the direction perpendicular to paper inlet 4. That is, paper holding plate 3 is divided by the paper inlet 4 into two asymmetrical parts. As second paper holding plate part 32 is shorter than first paper holding plate part 31, when the staple (or clip) on the stack of paper is located on the side of first paper holding plate part 31, the bottom piece of paper in the stack of paper has a short travel distance and rapidly enters paper inlet 4, and thus, the paper shredding efficiency is greatly improved.

In embodiments, the automatic paper shredder further includes a storage slot 41, which is formed in the outer side of the end, away from paper inlet 4, of first paper holding plate part 31, second paper holding plate part 32, or both, and is used to recover staples (or clips) for reutilization. In other embodiments, the automatic paper shredder further includes a storage plate 40, which is transversely disposed in the straight through-hole 9 and forms, together with the circumferential side wall of the straight through-hole 9, a half-open recovery slot 42, which is open upwards and is used to recover staples (or clips) for reutilization. The automatic paper shredder may further include magnet 43 which is disposed in storage slot 41 or recovery slot 42 and is used for attracting scattered staples (or clips).

Typically, paper pressing plate 8 is matched in shape with paper holding plate 3. Paper pressing plate 8 may be larger than, or as large as, paper holding plate 3. If paper pressing plate 8 is smaller than paper holding plate 3, both ends of the stack of paper may slightly tilt upwards, consequentially, affecting the staple removing effect in the later stage. Typically, the inner wall of paper holding box 2 is not provided with u-shaped or n-shaped holding strips, used for holding the four corners of the stack of paper, at horizontal positions corresponding to the upper surfaces of first paper holding plate part 31 and second paper holding plate part 32. In the prior art, due to the configuration of holding strips, the four corners of a stack of paper could be completely pressed under the condition where the internal size of paper holding box 2 is consistent with the size of the paper and the size of the paper pressing plate 8. This may severely affect the staple removing effect and may even result in failures to staple removal.

As shown in FIG. 1A, first lug 11 is disposed in the middle of the end, away from paper inlet 4, of first paper holding plate part 31. First lug 11 can have an upper surface generally even with the upper surface of first paper holding plate part 31 and extends towards the inner wall of paper holding box 2. Second lug 12 is disposed in the middle of the end, away from paper inlet 4, of second paper holding plate part 32. Third lug 13 is disposed at a position, corresponding to second lug 12, of the inner wall of paper holding box 2. The upper surfaces of second lug 12 and third lug 13 can be even with the upper surface of second paper holding plate part 32. Gap 14 is formed between second lug 12 and third lug 13. Second lug 12 is matched with third lug 13 in shape. Gap 14 can be in an arc shape, a concave/convex shape, a triangular shape or other suitable shape. In this embodiment, second lug 12 and third lug 13 are in a concave/convex shape.

In this embodiment, gap 14 is formed in the upper surfaces or lower surfaces of second lug 12 and third lug 13. Gap 14 penetrates through the upper surfaces and lower surfaces of second lug 12 and third lug 13. When gap 14 is formed in the upper surfaces of second lug 12 and third lug 13, second lug 12 is connected with the lower end of third lug 13, and straight through-hole 9 in the left sides and right sides of second lug 12 and third lug 13 is integrated with gap 14. When gap 14 is formed in the lower surfaces of second lug 12 and third lug 13, second lug 12 is connected with the upper end of third lug 13, and straight through-hole 9 in the left sides and right sides of second lug 12 and third lug 13 is integrated with gap 14. When gap 14 penetrates through the upper surfaces and the lower surfaces of second lug 12 and third lug 13, straight through-hole 9, in the left sides and right sides of second lug 12 and third lug 13, is integrated with gap 14.

Embodiment 2

Figure 3:
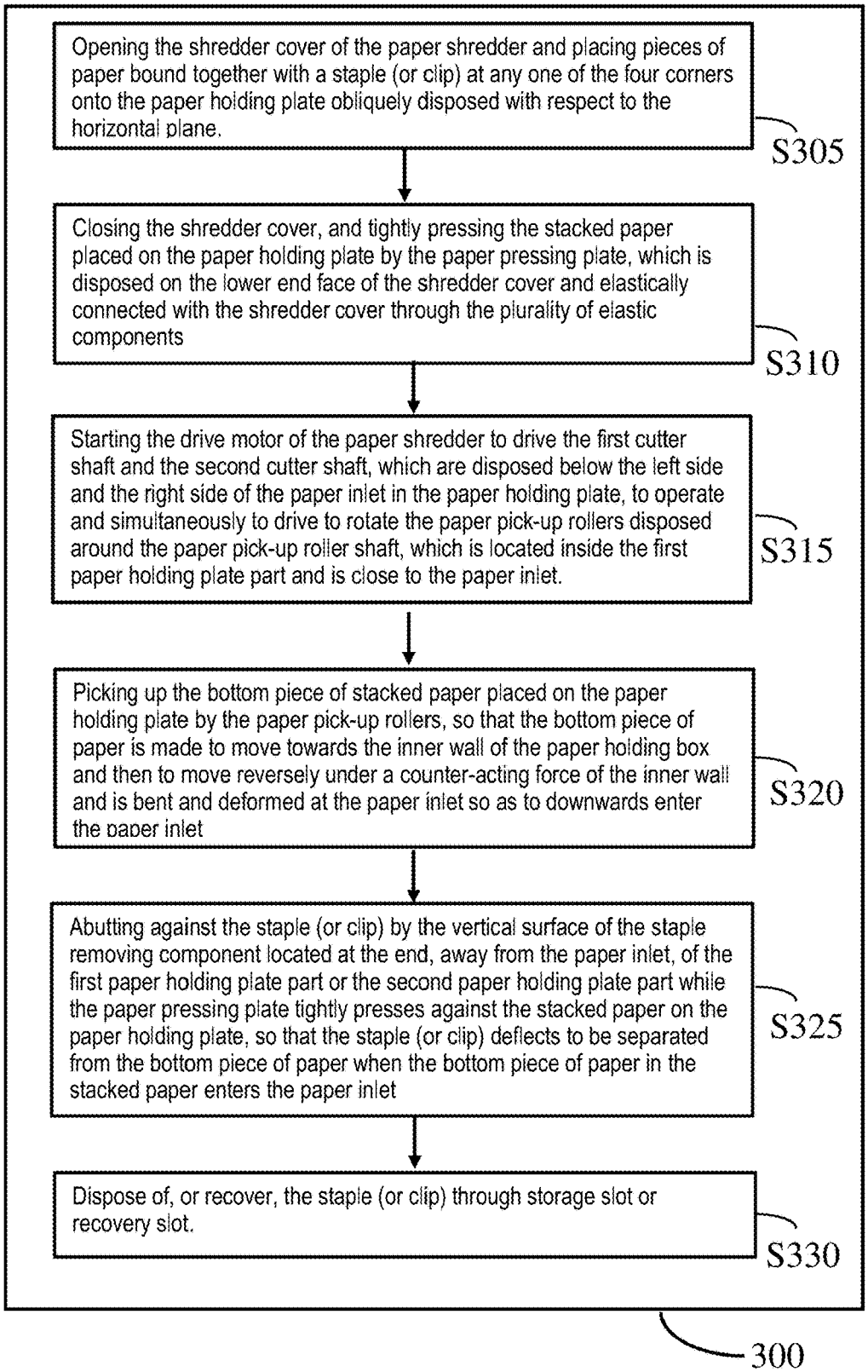
FIG. 3 is a flow diagram of a staple removing method using an automatic paper shredder of the invention.

As shown in FIG. 3, a staple removing method using an automatic paper shredder is provided. Staple removing method 300 can use the above-mentioned automatic paper shredder for paper shredding and staple removing. Method 300 can include opening the shredder cover of the paper shredder and then placing (S305) certain pieces of stacked paper bound together with a staple (or clip) at any one of the four corners on the paper holding plate obliquely disposed with respect to the horizontal plane. S310 can include closing the shredder cover and tightly pressing the stacked paper placed on the paper holding plate by the paper pressing plate, which is disposed on the lower end face of the shredder cover and elastically connected with the shredder cover through the plurality of elastic components. In S310, the lower surface of the paper pressing plate is parallel to the upper surface of the paper holding plate. Method 300 also includes starting the drive motor of the paper shredder to drive the first cutter shaft and the second cutter shaft, which are disposed below the left side and the right side of the paper inlet in the paper holding plate, thereby operating and simultaneously driving (S315) the paper pick-up rollers disposed around the paper pick-up roller shaft to rotate, which roller shaft is located inside the first paper holding plate part and is close to the paper inlet. Method 300 continues by picking up (S320) the bottom piece of stacked paper placed on the paper holding plate, by the paper pick-up rollers to move towards the inner wall of the paper holding box and then to move reversely under a counter-acting force of the inner wall, and bending and deforming the bottom piece at the paper inlet so as to downwardly enter the paper inlet, thus effecting left-end staple removal and a right-end staple removal. With the paper pressing plate tightly pressing (S325) against the stacked paper on the paper holding plate, the vertical surface of the staple removing component located at the end, away from the paper inlet, of the first paper holding plate part, or the second paper holding plate part, is abutting against the staple (or clip), so that the staple (or clip) deflects to be separated from the bottom piece of paper in the stacked paper when the bottom piece of paper enters the paper inlet. The staple removing component is parallel to the paper inlet.

Figure 4:
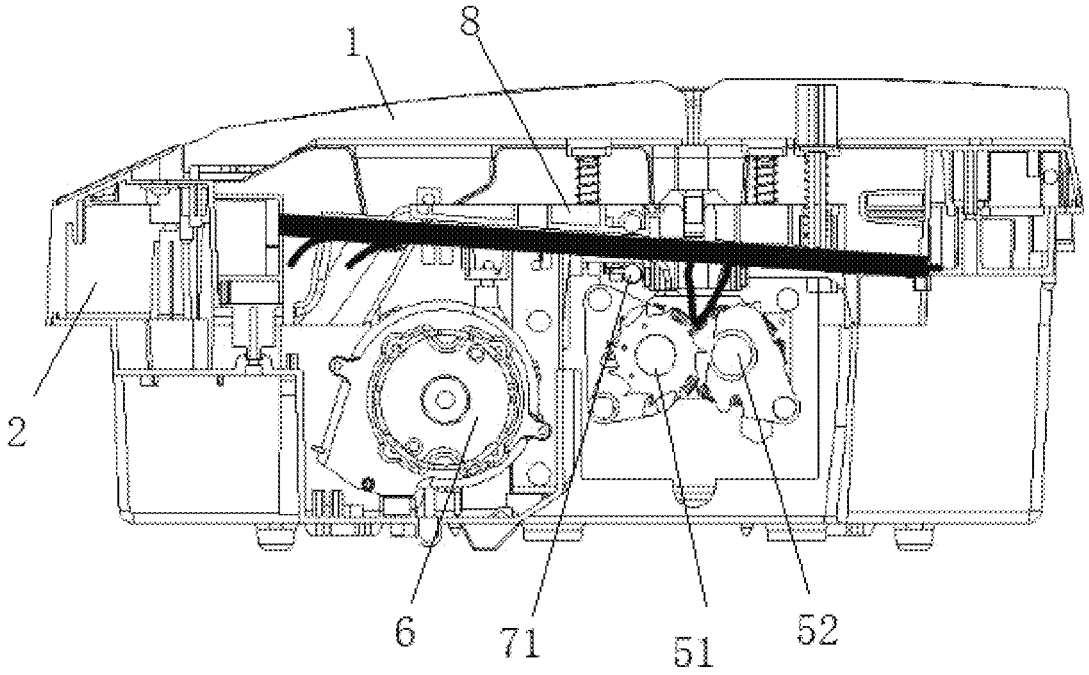
FIG. 4 is a schematic view of right-end staple removal during automatic paper shredding of the automatic paper shredder with the staple removing structure, in accordance with teachings of the present invention.
Figure 5:
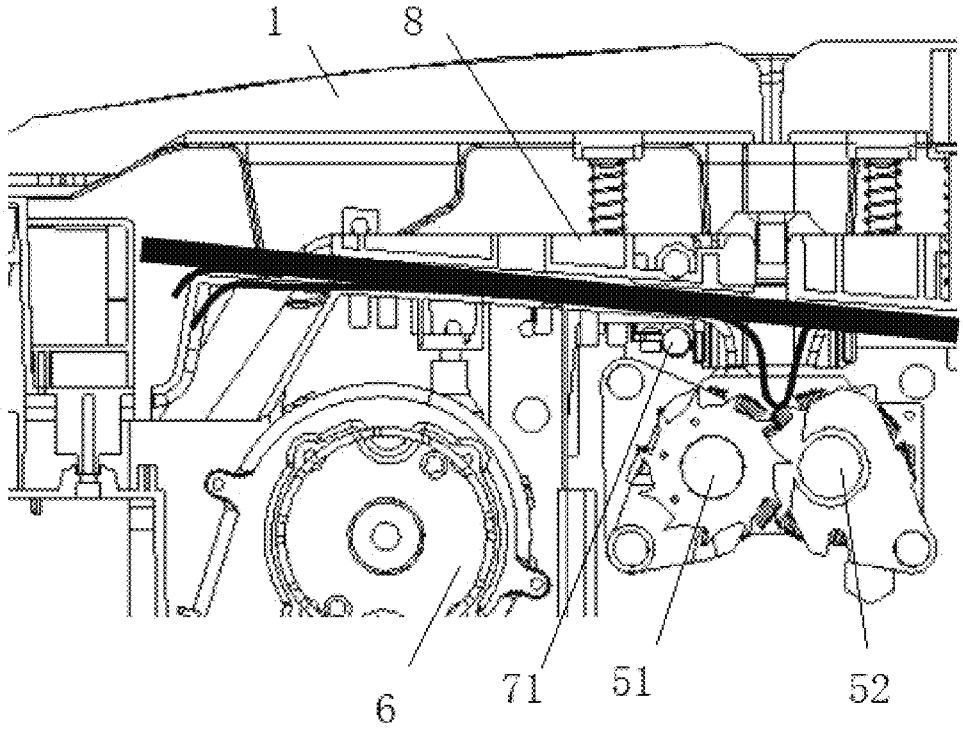
FIG. 5 is a partial enlarged view of right-end staple removal during automatic paper shredding of the automatic paper shredder with the staple removing structure, in accordance with teachings of the present invention.

FIG. 4 and FIG. 5 are illustrations of right-end staple removal during automatic paper shredding. In this case, the bottom piece of paper at the right end of the stacked paper is grabbed and torn down by cutter cores of the set of cutter shafts, below the paper inlet of the paper shredder. The piece of paper above the paper inlet of the paper shredder is reversely pulled and bent to the maximum degree until the bottom piece of paper is completely shredded, and the staple is removed from the next piece of paper in the same way until the last piece of paper is shredded.

Figure 6:
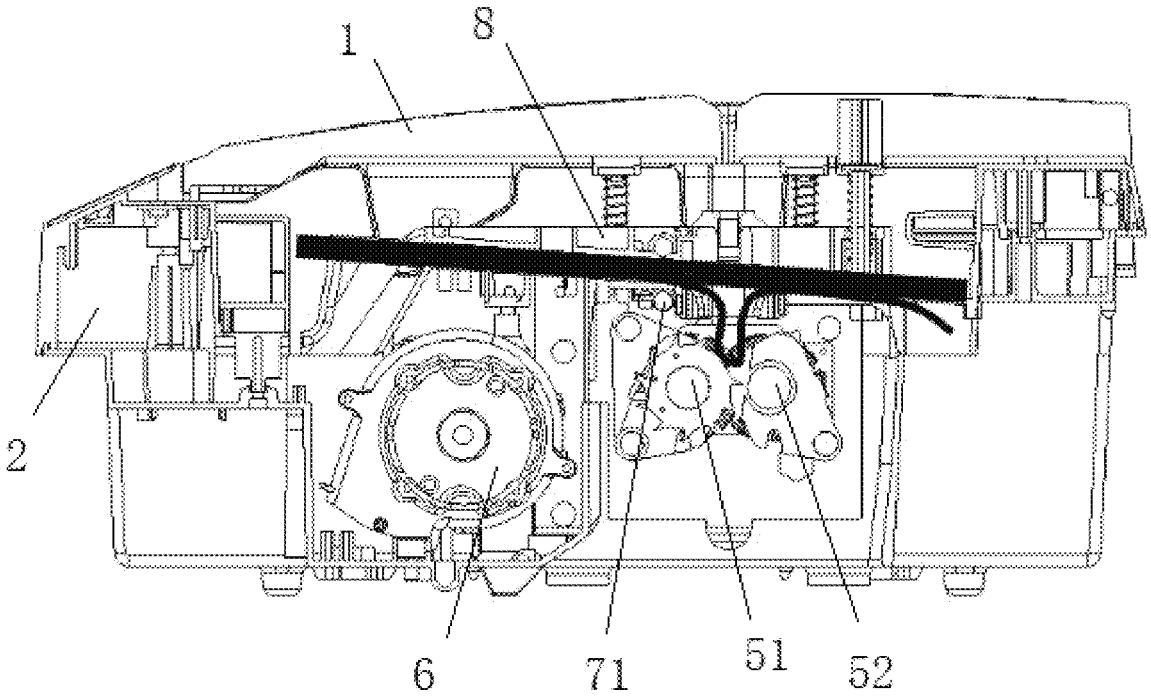
FIG. 6 is a schematic view of left-end staple removal during automatic paper shredding of the automatic paper shredder with the staple removing structure, in accordance with teachings of the present invention.
Figure 7:
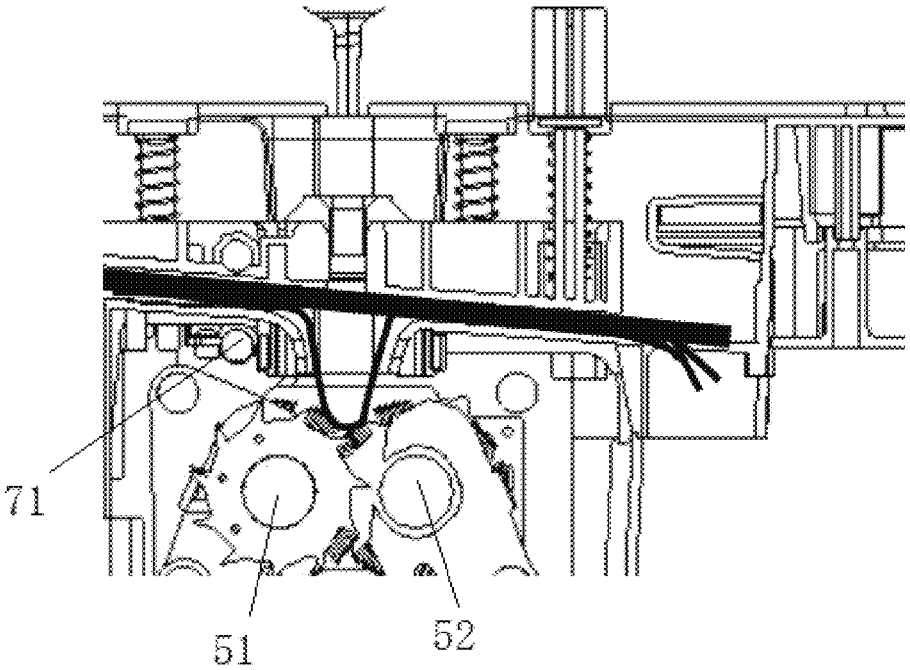
FIG. 7 is a partial enlarged view of left-end staple removal during automatic paper shredding of the automatic paper shredder with the staple removing structure, in accordance with teachings of the present invention.

FIG. 6 and FIG. 7 are schematic views of left-end staple removal during automatic paper shredding. In this case, the bottom piece of paper at the left end of the stacked paper is grabbed and torn down by cutter cores of the set of cutter shafts, below the paper inlet, of the paper shredder, the piece of paper above is reversely pulled and bent to the maximum degree until the bottom piece of paper is completely shredded, and the staple is removed from the next piece of the paper in the same way until the last piece of paper is shredded.

Furthermore, the staple removing method further may include S330, in which disposing of the staple (or clip) by the removed staple (or clip) falling into the waste paper bin located on the lower portion of the paper shredder after passing through the straight through-hole which is formed in one side or two sides of the paper holding plate and communicated with the waste paper bin. Alternately, the staple (or clip) can be recovered for reutilization, (1) through the storage slot which is formed in the outer side of the end, away from the paper inlet, of the first paper holding plate part and/or the second paper holding plate part; or, (2) through the half-open recovery slot which is open upwards and is formed by the storage plate transversely disposed in the straight through-hole and the circumferential side wall of the straight through-hole. The scattered staples (or clips) may be attracted by magnet 43 disposed in the storage slot or the recovery slot.

As variations, combinations and modifications may be made in the construction and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments but defined in accordance with the foregoing claims appended hereto and their equivalents.

The invention claimed is:

1. An automatic paper shredder with a staple removing structure, comprising:

a paper holding box;

a shredder cover, pivotally connected with one end of the paper holding box and closing or opening the automatic paper shredder;

a shell disposed below the paper holding box and fixedly connected with the paper holding box;

a paper holding plate disposed on an upper end face of an inner side of the paper holding box for holding a stack of paper placed thereon by users;

a paper inlet formed in the paper holding plate and divides the paper holding plate into a first paper holding plate part and a second paper holding plate part;

a paper shredding component having a first cutter shaft and a second cutter shaft, wherein the first cutter shaft and the second cutter shaft are respectively disposed below a left side and a right side of the paper inlet and are used in cooperation to shred paper entering the paper inlet;

a paper pick-up component including a paper pick-up roller shaft and paper pick-up rollers, which is disposed inside a first paper holding plate part and is close to the paper inlet, and the paper pick-up rollers are telescoped around the paper pick-up roller shaft, and wherein upper parts thereof partially protrude from an upper surface of the first paper holding plate part via paper pick-up holes formed in the first paper holding plate part, so that the paper pick-up rollers are driven by the drive motor to rotate, and a bottom piece of paper in the stack of paper placed on the paper holding plate is driven by the paper pick-up rollers to move towards an inner wall of the paper holding box and then to move reversely under a counteracting force of the inner wall, the bottom piece of paper being deformed at the paper inlet so as to move downwardly to enter the paper inlet;

a drive motor disposed inside the paper holding box, and connected with the first cutter shaft, the second cutter shaft and the paper pick-up component, wherein the drive motor drives the first cutter shaft and the second cutter shaft, and causes the paper pick-up component to operate;

a paper pressing plate elastically connected to a lower end face of the shredder cover through a plurality of elastic components, disposed correspondingly to an upper surface of the paper holding plate and tightly presses against the stack of paper placed on the paper holding plate when the users close the shredder cover;

a waste paper bin disposed inside the shell and is used for collecting paper scraps;

a straight through-hole located in one side or two sides of the paper holding plate and is communicated with the waste paper bin for removing staples or clips fallen into the waste paper bin located on a lower portion of the paper shredder through the straight through-hole; and a staple removing component located at an end of the first paper holding plate part away from the paper inlet, or located at an end of the second paper holding plate part away from the paper inlet, and the staple removing component used to abut against the staple or clip with a vertical surface while the paper pressing plate tightly presses against the stack of paper on the paper holding plate, so that the staple deflects and is separated from the bottom piece of paper when the bottom piece of paper in the stack of paper enters the paper inlet.

2. The automatic paper shredder with the staple removing structure according to claim 1, wherein the staple removing component is parallel to the paper inlet.

3. The automatic paper shredder with the staple removing structure according to claim 1, wherein the staple removing component is an angled part of the end of the first paper holding plate part away from the paper inlet, or the staple removing component is an angled part of the end of the second paper holding plate part away from the paper inlet.

4. The automatic paper shredder with the staple removing structure according to claim 1, wherein the staple removing component is a staple removing plate, which is fixedly disposed at an angled position of the end of the first paper holding plate part away from the paper inlet, or at an angled position of the end of the second paper holding plate part away from the paper inlet.

5. The automatic paper shredder with the staple removing structure according to claim 4, wherein the staple removing plate is made from metal.

6. The automatic paper shredder with the staple removing structure according to claim 1, wherein the paper holding plate is obliquely disposed by a certain angle with respect to a horizontal plane, and the first paper holding plate part and the second paper holding plate part sequentially incline downwards to allow the users to place the stack of paper thereon conveniently and to reduce a friction force on the stack of paper.

7. The automatic paper shredder with the staple removing structure according to claim 6, wherein a lower surface of the paper pressing plate is parallel to the upper surface of the paper holding plate.

8. The automatic paper shredder with the staple removing structure according to claim 1, wherein the first paper holding plate part is longer than the second paper holding plate part in a direction perpendicular to the paper inlet.

9. The automatic paper shredder with the staple removing structure according to claim 1, wherein the automatic paper shredder further comprises a storage slot, wherein the storage slot is formed in an outer side of the end of the first paper holding plate part, or the second paper holding plate part away from the paper inlet and is used to recover the staple or clip for reuse.

10. The automatic paper shredder with the staple removing structure according to claim 1, further comprising a storage plate, wherein the storage plate is transversely disposed in the straight through-hole and forms, together with a circumferential side wall of the straight through-hole, a half-open recovery slot which is open upwards and is used to recover the staple or clip for reuse.

11. The automatic paper shredder with the staple removing structure according to claim 10, wherein the automatic paper shredder further comprises a magnet for attracting scattered staples or clips, wherein the magnet is disposed in the storage slot or the recovery slot.

12. The automatic paper shredder with the staple removing structure according to claim 1, wherein the paper pressing plate is matched with the paper holding plate in shape, or the paper pressing plate is larger than or as large as the paper holding plate.

13. The automatic paper shredder with the staple removing structure according to claim 1, wherein the inner wall of the paper holding box is not provided with u-shaped or n-shaped holding strips at horizontal positions corresponding to upper surfaces of the first paper holding plate part and the second paper holding plate part for holding four corners of the stack of paper.

14. The automatic paper shredder with the staple removing structure according to claim 1, wherein a first lug is disposed in a middle of the end of the first paper holding plate part away from the paper inlet, and wherein the first lug has an upper surface even with the upper surface of the first paper holding plate part, and extends towards the inner wall of the paper holding box.

15. The automatic paper shredder with the staple removing structure according to claim 1, wherein:

a second lug is disposed in a middle of the end of the second paper holding plate part away from the paper inlet; and a third lug is disposed in the inner wall of the paper holding box at a position corresponding to the second lug, wherein the upper surfaces of the second lug and the third lug are even with an upper surface of the second paper holding plate part and a gap is formed between the second lug and the third lug, and the second lug is matched with the third lug in shape.

16. The automatic paper shredder with the staple removing structure according to claim 15, wherein:

when the gap is formed in the upper surfaces or lower surfaces of the second lug and the third lug or penetrates through the upper surfaces and lower surfaces of the second lug and the third lug;

when the gap is formed in the upper surfaces of the second lug and the third lug, the second lug is connected with a lower end of the third lug, and the straight through-hole in left sides and right sides of the second lug and the third lug is integrated with the gap;

when the gap is formed in the lower surfaces of the second lug and the third lug, the second lug is connected with an upper end of the third lug, and the straight through-hole in the left sides and right sides of the second lug and the third lug is integrated with the gap; and when the gap penetrates through the upper surfaces and lower surfaces of the second lug and the third lug, the straight through-hole in the left sides and right sides of the second lug and the third lug is integrated with the gap.

17. A staple removing method for paper shredding and staple removing using the automatic paper shredder according to claim 1, comprising:

opening the paper shredder, and placing a preselected amount of pieces of paper with any one of four corners bound together with a staple or clip on the paper holding plate obliquely disposed with respect to the horizontal plane;

closing the shredder cover, and pressing against the stack of paper on the paper holding plate by the paper pressing plate which is disposed on the lower end face of the shredder cover and elastically connected with the shredder cover through the plurality of elastic components;

starting the drive motor of the paper shredder to drive the first cutter shaft and the second cutter shaft, which are disposed below the left side and the right side of the paper inlet in the paper holding plate, to operate and simultaneously to drive the paper pick-up rollers telescoped around the paper pickup roller shaft, which is located inside the first paper holding plate part and is close to the paper inlet, to rotate;

picking up a bottom piece of stacked paper placed on the paper holding plate by the paper pick-up rollers, so that the bottom piece of paper is made to move towards the inner wall of the paper holding box and then to move reversely under a counter-acting force of the inner wall and is deformed at the paper inlet so as to move downwardly to enter the paper inlet; and abutting against the staple or clip by the vertical surface of the staple removing component located at the end of the first paper holding plate part or the second paper holding plate part away from the paper inlet, while the paper pressing plate tightly presses against the stacked paper on the paper holding plate, so that the staple or clip deflects and is separated from the bottom piece of paper when the bottom piece of paper in the stacked paper enters the paper inlet.

18. The staple removing method using an automatic paper shredder according to claim 17, wherein the lower surface of the paper pressing plate is parallel to the upper surface of the paper holding plate.

19. The staple removing method using an automatic paper shredder according to claim 17, wherein the staple removing component is parallel to the paper inlet.

20. The staple removing method using an automatic paper shredder according to claim 17, wherein the staple removing method further comprises enabling the removed staple or clip to pass through the straight through-hole which is formed in one side or two sides of the paper holding plate and communicated with the waste paper bin and then fallen into the waste paper bin located on the lower portion of the paper shredder.

21. The staple removing method using an automatic paper shredder according to claim 17, wherein the staple removing method further comprises:

recovering the staple or clip for reuse, by the storage slot which is formed in the outer side of the of the first paper holding plate part or the second paper holding plate part or both away from the paper inlet.

22. The staple removing method using an automatic paper shredder according to claim 17, further comprising:

recovering the staple or clip for reuse, by the half-open recovery slot which is open upwards and is formed by the storage plate transversely disposed in the straight through-hole and the circumferential side wall of the straight throughhole.

23. The staple removing method using an automatic paper shredder according to claim 20, further comprising, attracting scattered staples or clips by the magnet disposed in the storage slot or the recovery slot.

* * * * *